United States Patent [19]

Campo

[11] 4,258,846

[45] Mar. 31, 1981

[54] INTERLEAVED ROLLS OF WEB MATERIAL

[75] Inventor: Edgar A. Campo, Columbus, Ohio

[73] Assignee: E. I. Du Pont de Nemours and Company, Wilmington, Del.

[21] Appl. No.: 33,439

[22] Filed: Apr. 26, 1979

[51] Int. Cl.[3] ..... B65H 54/00; B65D 85/66

[52] U.S. Cl. ..... 206/412; 242/1; 242/54 R; 242/55; 428/78; 428/189; 428/194; 428/906

[58] Field of Search ..... 428/906, 78, 189, 194; 242/54 R, 1, 55, 58; 206/412, 389

[56] References Cited

U.S. PATENT DOCUMENTS

| | | | |
|---|---|---|---|
| 3,390,762 | 7/1968 | Mernieks | 206/412 |
| 3,575,289 | 4/1971 | Brousse | 428/906 |

*Primary Examiner*—Paul J. Thibodeau

[57] ABSTRACT

A means is disclosed for preventing the generation of wrinkles in wound rolls of web material. Wrinkles tend to form in wound rolls after an indefinite time of storage and growth of such post-forming wrinkles is eliminated by insertion of an interleaf of material into the outer layers of the rolled web.

7 Claims, 1 Drawing Figure

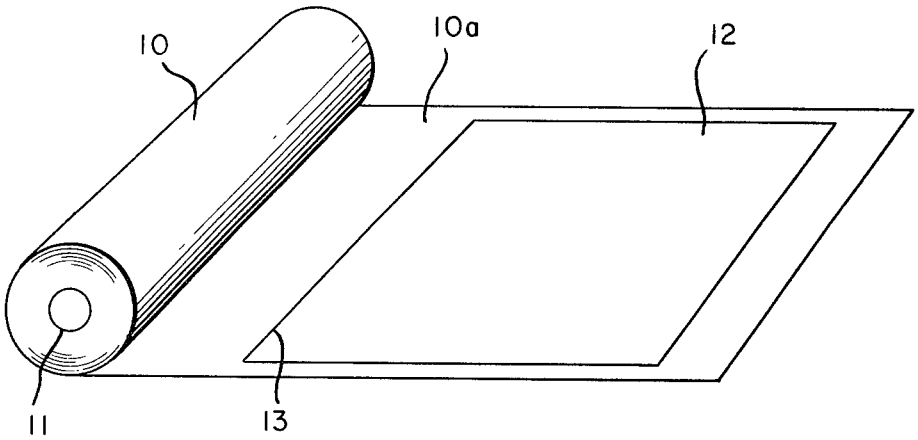
10
10a
12
11
13

INTERLEAVED ROLLS OF WEB MATERIAL

DESCRIPTION

1. Field of the Invention

This invention relates to wrinkle-free rolls of web material and to a method for making such rolls.

2. Background Art

It has long been a problem, in the manufacture of rolls of thin web material, that, after a short storage period, the rolls often generate wrinkles extending circumferentially about the roll to a depth in the roll of several hundred layers, or more, of the film. The reason for formation of the wrinkles is not well understood and the formation of the wrinkles causes a serious loss of material because the wrinkled portion of the rolls must often be discarded. Such post-formed wrinkles often cause the loss of a length of more than 1500 meters of the material on a roll. Moreover, such wrinkled rolls are not esthetically appealing and their quality may be questioned by prospective purchasers of the material.

In the past, several methods have been tried to mitigate the post-forming wrinkles and, while some of the methods may have provided benefit, all of the methods exhibited attendant disadvantages.

As an example, one method for reducing post-forming wrinkles has been to wind the last few thousand meters of web at reduced tension and, optionally, under reduced layon pressure. While wrinkle formation may be somewhat delayed, wrinkles usually do form anyway. This method is of especially little value in rolls of wide web material and in rolls of large diameter because the tendency toward post-forming wrinkles is greater in rolls of greater mass.

As another example, rolls have been made utilizing increased tension and, optionally, increased layon pressure. Such rolls are much harder and it is much more difficult for adjacent layers to slide over one another. Again, post-forming wrinkles are delayed, but are eventually generated, nevertheless.

Each of the above methods—looser winding and tighter winding—are uneconomical because those methods require additional winding time and occupy winding equipment for excessive durations.

There is some belief that post-forming wrinkles might be reduced if the web were coated or dusted with a slip agent or if the material contained such an additive. In all uses requiring, for example, pure film material, such additives would be unacceptable contaminants; and, for material which does not otherwise have some use or need for such an additive, the additive would be, at best, an undesirable nuisance.

Description of the Invention—According to the present invention, there is provided a wrinkle-free roll of web material of indefinite length having an interleaf located in the roll, between adjacent outer layers of the wound web material. There is also provided a method for making such wrinkle-free rolls of material by winding the material onto a roll core until the roll is of some predetermined desired size, laying an interleaf on the material and winding the interleaf and outer layers of the material to cover the interleaf.

The FIGURE depicts the product of this invention immediately before insertion of the interleaf.

In the FIGURE, there is shown roll 10 of web material wound onto core 11. Interleaf 12 is laid on web 10*a* and wound into roll 10 and then outer layers of web 10*a* are wound onto the roll 10 to cover interleaf 12. Although interleaf 12 need not be attached to web 10*a*, if desired, one or more edges or any area of the interleaf can be adhered to the web. In present practice, edge 13 of interleaf 12 is adhered to web 10*a* as a matter of convenience in handling the materials.

Web materials which are eligible for use in this invention include any which exhibit the above-described tendency to yield wrinkled rolls. Specific examples of those materials include regenerated cellulose, cellulose acetate, polycarbonate, fibrous cellulose (paper), polyethylene terephthalate, and the like.

While the invention is useful in rolls of any such material in any thickness which would result in wrinkling, post-forming wrinkles have been most often observed when the material is a film web and is less than about 50 micrometers thick. As a specific example, polyethylene terephthalate film less than 40 micrometers thick is particularly eligible; and film of that material in a thickness range of about 5 to 30 micrometers is particularly benefitted by the present invention.

The tendency for generation of wrinkled rolls increases as the width and diameter of the rolls are increased; and the benefits of the invention are realized when practiced on any roll of any material exhibiting the tendency to wrinkle. While not critical to practice of this invention, it can be noted that the benefits of the invention are particularly pronounced in rolls of material more than about 15 centimeters wide and more than about 25 centimeters in diameter on a core with a 15 centimeter diameter. It should be pointed out that post-forming wrinkles are present in a roll to a depth of as much as one-half to one centimeter and that wrinkles can form in rolls of material which include only that much film, thereby ruining the entire roll of material.

The interleaf can be made from a large variety of synthetic polymeric films of, for example, polyethylene terephthalate, polyethylene, polypropylene, polyvinyl chloride, and the like, and other materials such as paper or fibrous synthetic polymeric materials. The interleaf material can be coated or treated, for example, for antistatic qualities. It can be colored or not and may include printing. It may be in a single layer or may be a laminate. The interleaf material should be relatively dimensionally stable at temperatures and humidities normally encountered in the storage and use of wound rolls.

The thickness of the interleaf material is not important or critical. The interleaf material should only be thin enough to be flexible and thick enough to be easily handled. As a general rule, the interleaf material should be from about 25 to 200 micrometers thick and when polymeric films are used, the thickness is usually from about 25 to 150 micrometers thick.

It is believed that the interleaf of this invention is effective because it provides a spacing between outer layers of a wound roll and support for inner layers of the roll. Post-forming wrinkles can occur at locations across a wound roll where there is no interleaf even when there is an interleaf at other locations across the roll. Effectiveness is, therefore, increased by increasing the amount of interleaf material across the width of the roll. It is preferred that the interleaf material should be at least one-half as wide as the wound film and is usually as wide as the film. If desired or required for any reason, the interleaf can be wider than the film and can extend from one or both edges of the roll. While post-forming wrinkles are most often generated in the center one-half of a roll width and it is preferred that the interleaf should cover that area, the interleaf need not be centered in the width of the roll.

Experience has shown that the interleaf is most effective when it is long enough to extend for at least one-third of the circumference of a wound roll. While there appears to be no critical maximum length for the interleaf, at least one peripheral wrap is preferred, and it is believed that little additional benefit is derived from a length of more than about two times the circumference of the roll. While as little as one-third of a wrap of interleaf generally, adequately, provides the benefits of this invention, as a matter of convenience, the interleaf is usually used in lengths of about 1–4 meters regardless of roll diameter.

As to the depth of the interleaf in the outer layers of the roll, it is believed that the interleaf is most effective when located less than five or ten outer layers from the surface of the roll. As with other elements of this invention, however, the benefits of the invention can be realized even when the interleaf is located two hundred or more outer layers beneath the surface of the roll. It is preferred that the interleaf should be covered by at least one layer of the film material but that, also, is not critical. It is preferred that the interleaf should be near to the surface of the roll for convenience and economy in handling the material. Moreover, if the interleaf is located deep in the roll, for example, in the case of polyethylene terephthalate, more than about two hundred fifty layers, post-forming wrinkles will be generated in the layers above the interleaf. For the purpose of maintaining a proper perspective with regard to the number of layers of material included within the term "outer layers", it should be pointed out that a wound roll of thin film web material may have as many as 12,500 layers of the material.

The interleaf can be adhered to the film material or not; and, if adhered, can be adhered at one or more edges or over some or all of the surface.

DISCLOSURE OF PREFERRED EMBODIMENTS

Example 1

Three rolls of biaxially oriented, heat set, polyethylene terephthalate film were wound under the same conditions on commercial film winding equipment. Each roll was about 35 centimeters wide and about 35 centimeters in diameter on a core 15 centimeters in diameter. The film was about 12 micrometers thick.

In winding each roll, an interleaf of polyethylene terephthalate film 75 micrometers thick, 35 centimeters wide, and about 3 meters long was laid on the film material for winding into the roll about 5 to 10 meters from the end of the film material. The interleaves were adhered at one end to the film material by a strip of adhesive tape across the web, the interleaves and webs were wound into each roll, and the final layers of the film material were wound to cover the interleaves. The rolls were finished by a strip of adhesive tape across each roll over the end of the wound web. The rolls were stored in a relative humidity of approximately 50 percent and a temperature varying from about 21° to 26° C.

After four days, there were no post-forming wrinkles in any of the rolls. On that fourth day, the interleaf was removed from one of the rolls.

On the next day (the fifth day from commencement of this test), there were no wrinkles in the rolls with interleaves but in the roll with the interleaf removed, wrinkles had formed extending about half-way (180°) around the roll. On that fifth day, the interleaf was removed from one of the remaining rolls.

On the sixth day, there were no wrinkles in the roll with the interleaf but, in the rolls with the interleaves removed, two or three wrinkles had formed extending about 180° around the rolls. The wrinkles in the roll from which the interleaf was first removed, were substantially harder and deeper into the roll than they had been on the previous day. On that sixth day, the interleaf was removed from the remaining roll.

On the seventh day, all of the rolls had two or three post-forming wrinkles extending about 180° around each roll; and the wrinkles were harder and deeper in the rolls which had been longer without the interleaves.

In other tests it has been observed that post-forming wrinkles will not be generated on rolls, as above-described, for so long as the interleaf is maintained in place.

Example 2

In this example, film material about 6 micrometers thick was used to demonstrate the benefits of the invention on rolls of very thin film with a high tendency to generate post-forming wrinkles.

Two rolls of biaxially oriented, heat set, polyethylene terephthalate film were wound under the same conditions on commercial film winding equipment. One roll was about 50 centimeters wide and about 35 centimeters in diameter; and the other roll was about 65 centimeters wide and about 28 centimeters in diameter. Both rolls were made on cores 15 centimeters in diameter.

Interleaves of polyethylene terephthalate film 75 micrometers thick and about 37 micrometers thick were inserted into the rolls as described in Example 1.

The rolls were set aside for 5 hours under conditions specified in Example 1 and no post-forming wrinkles were generated in either roll. After 5 hours, the interleaves were removed from both rolls. Post-forming wrinkles were visible within 30 minutes after removal of the interleaves and within four hours each roll had 6 to 8 wrinkles extending from 180 to 360 degrees around the rolls.

Example 3

In this example, rolls of biaxially oriented, heat set, polyethylene terephthalate film about 20 micrometers thick were wound to be about 50 centimeters wide and about 35 centimeters in diameter on a core having a diameter of 15 centimeters. An interleaf of a thickness, kind, and size as described in Example 1, was inserted into one of the rolls.

Wrinkles formed after about two days in rolls without the interleaf and, in seven days, the wrinkles were hardened and deep into the rolls. Wrinkles did not form in the roll with the interleaf over the seven-day observation period.

Example 4

In this example, a roll of tensilized, heat set, polyethylene terephthalate film about 12 micrometers thick was wound to be about 65 centimeters wide and about 35 centimeters in diameter on a core about 15 centimeters in diameter. Tensilized film is film which has been oriented more in the direction parallel with the length of the film than in the direction transverse to the length of the film.

The roll was wound without an interleaf and post-forming wrinkles were evident after only one day.

The roll was unwound and rewound without an interleaf and post-forming wrinkles were again evident after only one day.

The outer layers of the roll which were affected by the wrinkles were cut away with a knife to yield a smooth roll and post-forming wrinkles were evident after three days.

The roll was unwound and rewound to a diameter of about 34 centimeters and an interleaf was inserted into the end of the roll the same width as the film material and of a kind and size otherwise specified in Example 1 and in accordance with the procedure described therein. No post-forming wrinkles were evident after 10 days of observation.

Example 5

In this example, several different interleaf materials were used in rolls of biaxially oriented, heat set, polyethylene terephthalate film about 12 micrometers thick.

Rolls were wound which were about 65 centimeters wide and about 28 centimeters in diameter on a core with a diameter of about 15 centimeters. Interleaves of polyethylene film material 125 micrometers thick and filled, translucent, polyethylene terephthalate 125 micrometers thick were inserted into individual rolls.

Rolls were wound which were about 33 centimeters wide and about 35 centimeters in diameter on a core with a diameter of about 15 centimeters. An interleaf of polyethylene terephthalate 125 micrometers thick with a thin, reflective, coating of aluminum and zinc on one surface was inserted into a roll.

None of the rolls with the interleaves generated any post-forming wrinkles while all equivalent rolls wound without interleaves exhibited post-forming wrinkles after only one day.

I claim:

1. A wrinkle-free roll of web material of indefinite length and more than about two hundred fifty layers having an interleaf located in the roll, less than about two hundred outer layers beneath the surface of the roll, said interleaf having a width of more than about one-half of the width of the web material and a length of more than about one-third of the circumference of the roll.

2. The roll of claim 1 wherein the interleaf comprises a synthetic polymeric film.

3. The roll of claim 1 wherein the interleaf is substantially the same width as the roll.

4. The roll of claim 1 wherein the web material is a film of polyethylene terephthalate.

5. A process for winding a wrinkle-free roll of web material of indefinite length and more than about two hundred fifty layers comprising the steps of:

(i) winding the web material onto a roll core until the roll is of a predetermined, desired size, (ii) laying an interleaf with a width of more than about one-half of the width of the web material and a length of more than about one-third of the circumference of the roll on the web material, and (iii) winding the interleaf and outer layers of the web material to cover the interleaf with less than about two hundred outer layers of web material.

6. The process of claim 5 wherein the interleaf is adhered to the web material on at least one edge of the web.

7. A process for completing the winding of a wrinkle-free roll of web material of indefinite length and more than about two hundred fifty layers comprising the steps of:

(i) laying an interleaf with a width of more than about one-half of the width of the web material and a length of more than about one-third of the circumference of the roll on the web of a roll of material and (ii) winding the interleaf and outer layers of the web material to cover the interleaf with less than about two hundred outer layers of web material.

* * * * *